United States Patent [19]

Ginzburg et al.

[11] Patent Number: 4,599,883

[45] Date of Patent: Jul. 15, 1986

[54] TANDEM ROLLING MILL

[75] Inventors: Vladimir B. Ginzburg, Pittsburgh; Remn M. Guo, Monroeville, both of Pa.

[73] Assignee: Wean United, Inc., Pittsburgh, Pa.

[21] Appl. No.: 752,021

[22] Filed: Jul. 5, 1985

[51] Int. Cl.[4] ..... B21B 1/24; B21B 29/00

[52] U.S. Cl. ..... 72/234; 72/199; 72/241

[58] Field of Search ..... 72/234, 226, 199, 241, 72/243, 365, 366

[56] References Cited

U.S. PATENT DOCUMENTS

| | | | |
|---|---|---|---|
| 1,810,167 | 6/1931 | George | 72/234 X |
| 1,946,240 | 2/1934 | Rohn | 72/234 X |
| 2,139,872 | 12/1938 | Worthington | 72/234 X |
| 2,620,513 | 12/1952 | Cryor | 72/234 X |
| 3,645,121 | 2/1972 | Pheiffer et al. | 72/234 X |
| 3,726,119 | 4/1973 | Bindernagel | 72/234 |
| 3,850,020 | 11/1974 | Webster et al. | 72/199 |
| 3,861,188 | 1/1975 | Kamit et al. | 72/234 |
| 3,877,275 | 4/1975 | Attwood | 72/234 X |
| 4,479,374 | 10/1984 | Feldmann et al. | 72/234 X |

FOREIGN PATENT DOCUMENTS

| | | | |
|---|---|---|---|
| 0019955 | 2/1978 | Japan | 72/234 |
| 2081151 | 2/1982 | United Kingdom | 72/241 |

*Primary Examiner*—Francis S. Husar
*Assistant Examiner*—Steve Katz
*Attorney, Agent, or Firm*—Arnold B. Silverman

[57] ABSTRACT

A tandem rolling mill having a plurality of stands with each stand having a pair of work rolls and a pair of backup rolls. A downstream roll stand has work rolls of reduced diameter and backup rolls of increased diameter with respect to an upstream stand preferably at least a major number of downstream stands have reduced diameter work rolls and enlarged diameter work rolls with respect to an upstream stand. The center-to-center spacing between work rolls and backup rolls decreases in a downstream direction and the length of the rolls increases from stand-to-stand in a downstream direction.

15 Claims, 4 Drawing Figures

TANDEM ROLLING MILL

BACKGROUND OF THE INVENTION

1. Field of the Invention

This invention relates to an improved construction for tandem rolling mills and, more specifically, it relates to such improvements which may advantageously be employed in hot strip mills.

2. Description of the Prior Art

It has been know, in connection with various types of multi-stand rolling mills, to provide variations in the diameter of the rolls so as to achieve certain objectives.

In the interest of facilitating ease of maintenance construction and interchangeability of parts, it has been known to provide tandem rolling mills wherein the rolls of successive stands are of the same diameter.

U.S. Pat. No. 3,645,121 which relates to the rolling of tubular stock, discloses a system wherein the work rolls are of progressively larger diameter. U.S. Pat. No. 3,877,275 discloses a cold roll reduction mill which is adapted to form various structural members and has rolls of diameter increasing in the downstream direction.

U.S. Pat. No. 1,946,240 after stating that it was known in the prior art to successively decrease the diameters of rolls in the hot rolling of steel strips, suggests the use of rolls of the same diameter for most or all of the rolling stations, and, also teaches the use of increased distance between sequentially positioned pairs of rolls in the downstream direction.

U.S. Pat. No. 3,861,188 discloses roll systems for forming checkered thin plates and teaches the use in certain stands of one work roll of a different diameter from the other.

U.S. Pat. No. 2,139,872 discloses the use of opposed rolls of different diameter and sequential reduction in diameter of both the work rolls and the backup rolls in a downstream direction.

U.S. Pat. No. 4,479,374 discloses roll length being reduced sequentially in a downstream direction.

U.S. Pat. No. 1,810,167 discloses reduction in diameter of work rolls in a downstream direction combined with increased spacing between successive roll stands in a downstream direction.

In spite of the foregoing disclosures, there remains a need for improved tandem rolling mill constructions wherein the relationships between roll diameters, spacing between adjacent stands and roll length may be combined so as to maximize efficiency of operation of the mill.

SUMMARY OF THE INVENTION

The present invention has met the above described need. In a preferred embodiment, a plurality of stands, each having a pair of work rolls and a pair of backup rolls, are provided. The work rolls of a downstream roll stand have a diameter smaller and the backup rolls have a larger diameter than the diameters of work rolls and backup rolls of a roll stand disposed upstream therefrom. Preferably, at least a major number of downstream roll stands have reduced diameter work rolls and enlarged diameter backup rolls with respect to an upstream stand.

The successive stands preferably have reduced center-to-center spacing between rolls on a first stand and rolls on a downstream stand and rolls of increased length in a downstream direction. The tandem rolling mill may function advantageously as a finishing train for a hot strip mill.

It is an object of the present invention to provide a tandem rolling mill construction which facilitates reduced rolling loads and reduced rolling torque.

It is a further object of this invention to provide improved tandem rolling mill construction with improved profile, i.e., crown, flatness and edge control, steering and temperature control through precisely controlled variations in roll diameter, roll length and relative spacing between stands.

It is a further object of the present invention to provide such a mill construction which is adapted for advantageous use in finishing trains of hot strip mills.

It is another object of the invention to provide such a mill which produces improved quality metal strip.

These and other objects of this invention will be more fully understood from the following description of the invention on reference to the illustrations appended hereto.

DESCRIPTION OF THE PREFERRED EMBODIMENTS

Figure 1:
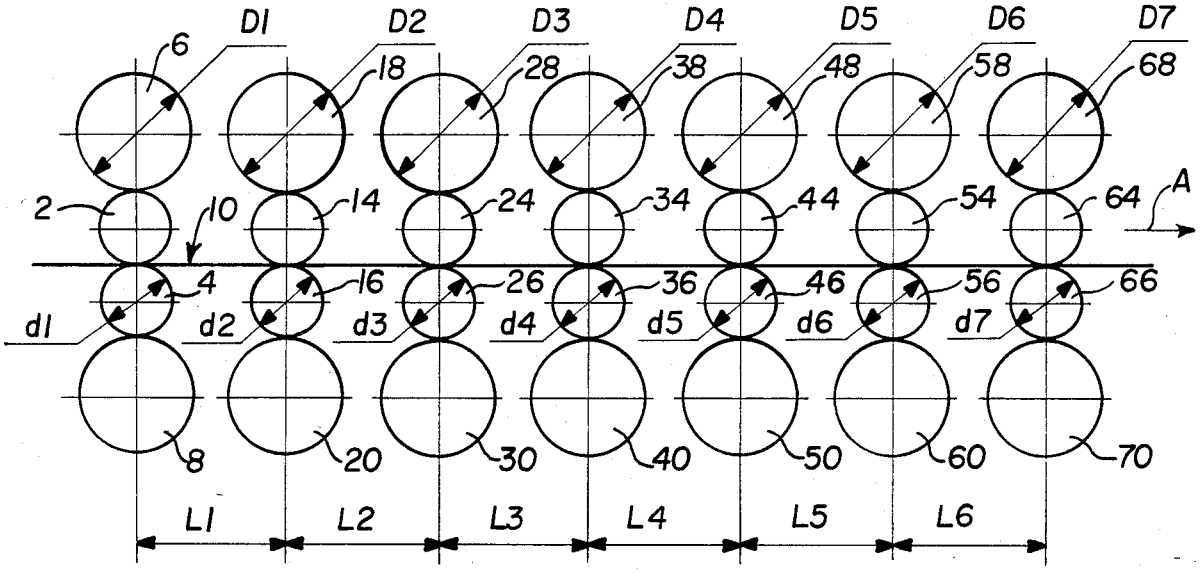
FIG. 1 is a schematic illustration showing a plurality of mill stands dimensioned in accordance with a preferred embodiment of the present invention.
Figure 2:
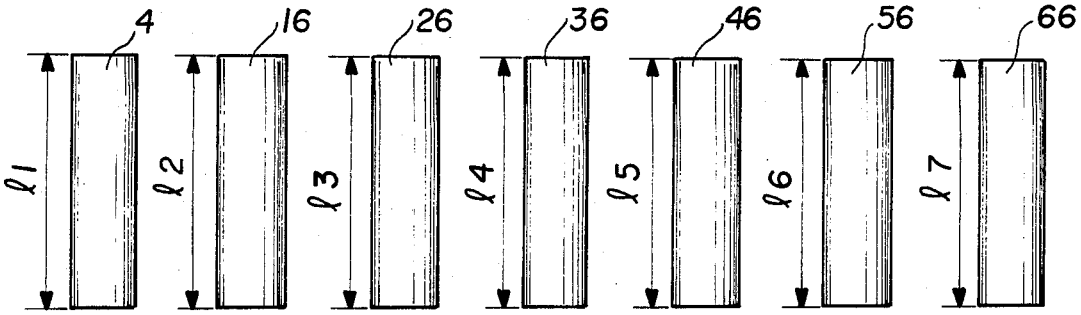
FIG. 2 is a schematic illustration showing a plurality of working rolls of the present invention.

Referring now to FIG. 1 in greater detail, there is shown schematically, a tandem rolling mill construction of the present invention. (As the dimensional changes of the drawing of the scale shown would be too small to be shown effectively in the drawings, for illustration purposes, they have been shown as being substantially of identical size although it will be appreciated from what follows hereinafter that predetermined variations in dimensions will be provided.)

The first rolling mill stand has a pair of work rolls of diameter d1 associated with a strip 10 which is traveling in the direction of the arrow A or from left to right in FIG. 1. A pair of backup rolls 6,8 of diameter D1 are operatively associated with the work rolls 2,4. A second stand disposed downstream from the first has a pair of work rolls 14,16 of diameter d2 cooperating with backup rolls 18,20 of diameter D2. It will be noted that within a stand, the work rolls which cooperate with each other are of a substantially identical diameter as are the backup rolls of substantially equal diameter to each other. The spacing between the rolls in the first train and the rolls in the second train, measured from center-to-center, is L1.

Referring still to FIG. 1, it is noted that the next downstream train has work rolls 24,26 of diameter d3 and backup rolls 28,30 of diameter D3. This train is spaced from the second train by a distance L2. Similarly, the next stand has work rolls 34,36 of diameter d4 and backup rolls 38,40 of diameter D4. The next stand has work rolls 44,46 of diameter d5 and backup rolls 48,50 of diameter D5. The next downstream stand has work rolls 54,56 of diameter d6 and backup rolls 58,60 of diameter D6. The last illustrated stand has a pair of work rolls 64,66 of diameter d7 and backup rolls operatively associated therewith 68,70 having diameter D7.

The invention contemplates a downstream stand having work rolls of a reduced diameter and backup rolls of an enlarged diameter with respect to an upstream stand. In the preferred practice of the present invention, at least a major number of downstream stands will have work rolls of a diameter less and backup rolls greater than corresponding rolls of an upstream stand. As a result, work roll d7 will be smaller than any work roll diameter in the group from d1 through d6. Similarly, backup roll diameter D7 will be greater than any of the diameters of the backup rolls in the group D1 through D6. It will generally be preferred that the smallest diameter work rolls (d7) will be about 70 to 80 percent of the diameter of the largest diameter work roll (d1). Similarly, it will be preferred that the smallest diameter backup roll (D1) will have a diameter of about 85 to 90 percent of the largest diameter backup roll (D7).

It has been found that as the downstream stands will be subjected to a lower roll separating force and lower rolling torque, the reduced diameter of work rolls combined with the large diameter backup rolls will effect the desired rolling to produce a product of suitable quality without adversely affecting operation of the multi-stand mill. The reduction in roll separating force resists undesired roll deflection which would tend to produce an objectionable crown on the strip being rolled. The reduction in torque permits the use of work rolls of further reduced diameter. Increasing the backup roll diameter serves to contribute to greater mill stand rigidity thereby further resisting undesired work roll deflection. Such construction is particularly useful in connection with a finishing train for a hot strip mill.

It has also been found that the successive center-to-center spaces between the respective rolling mill stands may be reduced advantageously. This results in spacing L1 being greater than spacing L2 which in turn is greater than spacing L3. Space L6 is the smallest. This serves to facilitate decreasing of temperature losses and improvement in the conditions for steering of the strip from stand to stand.

Finally, with respect to the roll length, it is preferred that the length be increased in a downstream direction such that length l1 of work roll 4 will be smaller than length l2 of work roll l6 which in turn will be smaller than the length l3 of work roll 26, with length l7 of work roll 66 being the largest. This serves to improve the conditions for steering and the more effective use of work roll bending for better strip crown, flatness and strip edge.

Figure 3:
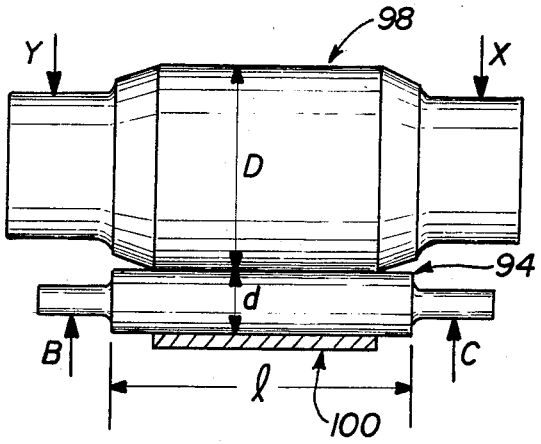
FIG. 3 is a schematic elevational illustration of a pair of rolls of the present invention.

Referring in greater detail to FIG. 3, there is shown the upper half of a mill stand having a work roll 94 and an associated backup roll 98 which cooperate with the rolls (not shown) to reduce strip 100. Compared with an upstream stand, work roll 94 has a reduced diameter d, backup roll 98 has an enlarged diameter and an enlarged work roll 94 length 1. As the mill stand applies a compressive force to the strip 100, work roll 94 is subjected to forces which would urge work roll 94 to have a centrally crowned, downwardly concave configuration. Resistance to such deformation is provided by backup roll 98 by the roll forces (X,Y) applied to the backup roll necks to create opposing moments; external roll bending forces (B,C) applied to the work roll necks create deformation resisting moments about a fulcrum at the axial center of the work roll 94. It will be appreciated that a distinct advantage of increasing length l is that forces B,C are moved further from the fulcrum thereby increasing the moment arms of the moments resisting undesired work roll deflection, the result of which is further heightened by the advantage of employing smaller diameter work rolls.

Figure 4:
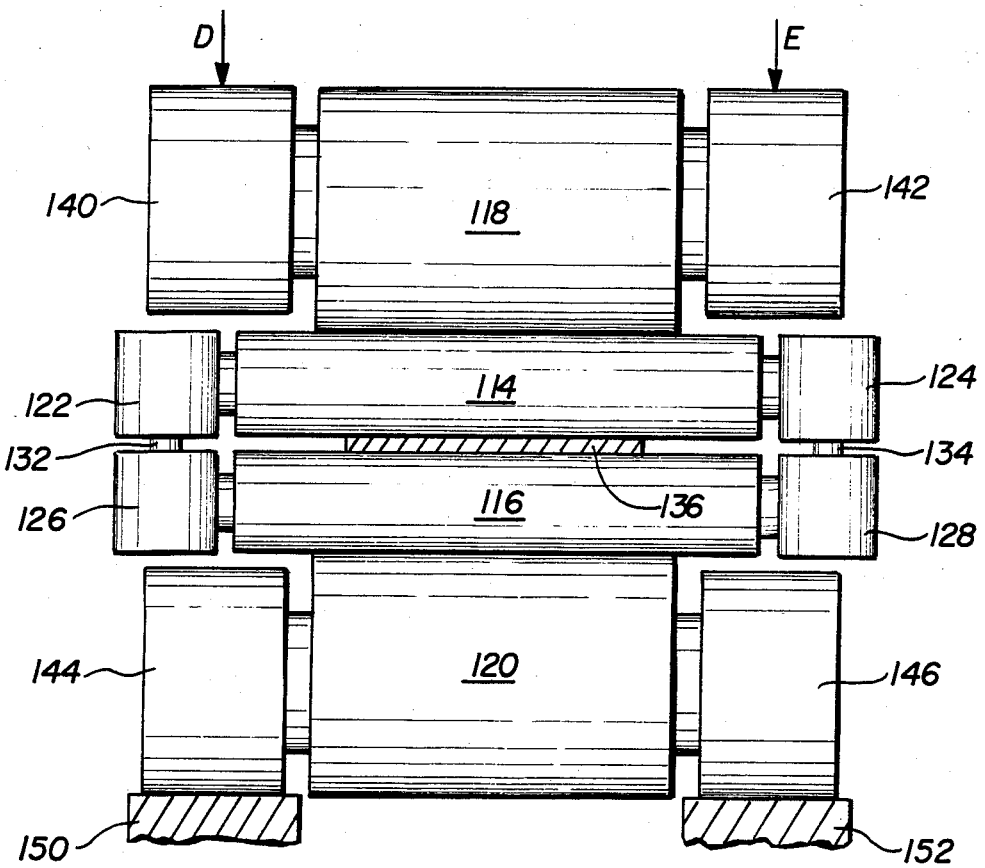
FIG. 4 is a schematic elevational view of a retrofit arrangement of the present invention.

FIG. 4 illustrates schematically a mill stand which represents a manner in which existing prior art stands may be retrofitted to achieve the benefits of this invention. Work rolls 114,116 of enlarged length with respect to the work rolls which they replace, are secured within suitable bearings (not shown) and respectively, work roll chucks 122,124 and 126,128. Roll bending cylinders 132,134 operate respectively with chucks 22,126 and 124,128. Backup rolls 118,120 are secured within suitable bearings (not shown) and, respectively, within roll chucks 140,142 and 144,146 contained in the usual manner in the housings where, as indicated in FIG. 4, the chucks 123,124 and 126,128 of the work rolls, because of their increased length, are offset and the chucks would be restrained in such manner as to allow the usual vertical movement. It will be noted that rolls 114,116 have a greater length than rolls 118,120. The preexisting housing has supports 150,152. Strip 136 is subjected to the desired reduction, while the stand through the increased length and reduced diameter of work rolls 114,116 and enlarged backup roll diameters with roll forces (such as D,E on roll 118) resist undesired work roll deflection. The relative dimensions of the rolls have such that existing housings can be retrofitted efficiently.

EXAMPLE

In order to provide additional understanding as to the nature of the invention, a specific example will be considered. In a seven stand tandem hot mill, the following dimensions may be employed.

| Stand | d (inches) | D (inches) | l (inches) | L (feet) |
|---|---|---|---|---|
| 1 | 28 | 60 | 80 | 18 |
| 2 | 26 | 62 | 80 | 18 |
| 3 | 24 | 64 | 80 | 18 |
| 4 | 23 | 65 | 90 | 17 |
| 5 | 22 | 66 | 100 | 16 |
| 6 | 21 | 67 | 110 | 15 |
| 7 | 20 | 68 | 120 | 15 |

While, for convenience of disclosure, reference has been made to specific stands wherein each successive downstream stand has the dimensional changes of the invention, it will be appreciated that not all of the changes need be made in each successive roll stand. For example, two or more successive stands may have rolls of identical dimensions or some dimensions may be changed without changing others. A pair of adjacent stands, for example, may have the changed diameters without altering work roll length or relative stand spacing. A pair of adjacent stands may have work roll diameter and length changed without making other changes, for example.

It will be appreciated, therefore, that the present invention provides an efficient means for taking advantage of the roll separating forces and roll torque in the downstream stands so as to provide for unique dimensional relationships in respect to roll sizes of the work rolls and backup rolls as well as spacing between stands and roll lengths. This produces a product of improved quality, reduction in the temperature losses and improved steering and profile control.

Whereas particular embodiments of the invention have been described above for purposes of illustration, it will be evident to those skilled in the art that numerous variations of the details may be made without departing from the invention as defined in the appended claims.

We claim:

1. A tandem rolling mill comprising
a plurality of mill stands each having a pair of work rolls and a pair of associated backup rolls, and
a downstream roll stand having work rolls of reduced diameter and backup rolls of increased diameter with respect to the diameters of the work rolls and backup rolls of an upstream stand.

2. The tandem rolling mill of claim 1 including
the work rolls within said stand being of substantially equal diameter, and
the backup rolls within said stand being of substantially equal diameter.

3. The tandem rolling mill of claim 1 including
at least a major number of downstream roll stands having work rolls of reduced diameter and backup rolls of enlarged diameter with respect to an upstream stand.

4. The tandem rolling mill of claim 3 including said rolling mill is a strip mill.

5. The tandem rolling mill of claim 4 including said rolling mill is a hot mill.

6. The tandem rolling mill of claim 5 including said stands provides a finishing train.

7. The tandem rolling mill of claim 1 including at least a major number of said downstream stands having work rolls of a greater length than the work rolls of a said stand disposed upstream therefrom, whereby work roll bending forces applied to roll edges will produce increased moments resisting undesired work roll deflection of said downstream work rolls.

8. The tandem rolling mill of claim 7 including the center-to-center spacing between work rolls of adjacent said stands being less than the center-to-center spacing of work rolls of adjacent said stands disposed upstream therefrom.

9. The tandem rolling mill of claim 8 including each said pair of work rolls disposed on a said stand having rolls of substantially equal diameter.

10. The tandem rolling mill of claim 9 including each said pair of backup rolls on a said stand having rolls of substantially the equal diameter.

11. The tandem rolling mill of claim 1 including said rolling mill train being a finished train for a hot strip mill, and
the smallest diameter work roll having a diameter of about 70 to 80 percent of the largest diameter work roll in said finishing train.

12. The tandem rolling mill of claim 11 including the smallest diameter backup roll having a diameter of about 85 to 90 percent of the largest diameter backup roll in said finishing train.

13. A tandem rolling mill comprising
a plurality of mill stands each having a pair of work rolls and a pair of associated backup rolls, and
a downstream roll stand having work rolls of reduced diameter and increased length with respect to the diameters and lengths of work rolls of an upstream stand.

14. The tandem rolling mill of claim 13 including
the work rolls within a said stand being of substantially equal diameter.

15. The tandem rolling of claim 14 including
at least a major number of downstream roll stands having work rolls of reduced diameter and increased length with respect to an upstream stand.

* * * * *

UNITED STATES PATENT AND TRADEMARK OFFICE

CERTIFICATE OF CORRECTION

PATENT NO. : 4,599,883

DATED : July 15, 1986

INVENTOR(S) : Vladimir B. Ginzburg and Remn M. Guo

It is certified that error appears in the above-identified patent and that said Letters Patent is hereby corrected as shown below:

On the Title Page, the Assignee should be --Wean United, Inc./International Rolling Mill Consultants, Inc.--

Column 1, line 11, "know" should be --known--.

Signed and Sealed this

Eleventh Day of November, 1986

*Attest:*

DONALD J. QUIGG

*Attesting Officer* *Commissioner of Patents and Trademarks*